US005161549A

United States Patent [19]

Rosario

[11] Patent Number: 5,161,549

[45] Date of Patent: Nov. 10, 1992

[54] PURE CLEAN CIGARETTE FILTER

[75] Inventor: Felix D. Rosario, Miami Springs, Fla.

[73] Assignee: Regional Research & Development Corporation, Miami, Fla.

[21] Appl. No.: 596,643

[22] Filed: Oct. 12, 1990

Related U.S. Application Data

[63] Continuation-in-part of Ser. No. 494,297, Mar. 20, 1990, abandoned.

[51] Int. Cl.[5] ..... A24D 3/10; A24D 3/14

[52] U.S. Cl. ..... 131/331; 131/334; 131/341; 131/345

[58] Field of Search ..... 131/331, 334, 341, 345

[56] References Cited

U.S. PATENT DOCUMENTS 3,368,566 2/1968 Avedikian ..... 131/331

4,753,250 6/1988 Bitter et al. ..... 131/335

*Primary Examiner*—V. Millin

*Attorney, Agent, or Firm*—Rothwell, Figg, Ernst & Kurz

[57] ABSTRACT

An improved tobacco smoke filter which retains a majority of the tar and nicotine and noxious gases from tobacco smoke. The filter is composed of fibrous filaments having equal quantities of two organic acids or salts of organic acids or polyhydric alcohols dispersed throughout the fibrous filaments.

29 Claims, 3 Drawing Sheets

PURE CLEAN CIGARETTE FILTER

BACKGROUND OF THE INVENTION

1. Field of the Invention

This is a continuation-in-part application of application Ser. No. 494,297 filed Mar. 20, 1990 now abandoned. This invention relates to an improved tobacco smoke filter. More particularly, this invention relates to a tobacco smoke filter that retains a majority of the tar and nicotine as well as some of the noxious gases from tobacco smoke.

2. Prior Art

Although tobacco smoke filters have come into widespread use, especially for cigarettes, these currently available filters do not remove an adequate amount of the noxious substances, such as tar, nicotine, carbon monoxide, nitrous oxides and the like which typically lead to cancer, heart disease or emphysema. Several types of tobacco smoke filters as well as tobacco substitutes have been developed in an attempt to reduce the health hazards of tobacco smoke and at the same time allow the smoker to enjoy the pleasure of smoking tobacco. However, none of the current filters or tobacco substitutes have proven to be effective in adequately retaining large amounts of tar, and nicotine and noxious gases to reduce the health hazards of tobacco smoke.

U.S. Pat. No. 3,368,566, discloses a method for filtering noxious gases from cigarette smoke consisting of seven filters. The fifth filter contains acidic substances, such as sodium bisulfate and/or sodium acid phosphate, citric acid, and sodium acid tartrate, which remove vaporized nicotine and other organic amines. However, the disclosure does not specify the quantities of the acidic substances employed or the quantities of nicotine and other amines removed from the tobacco smoke.

U.S. Pat. No. 3,112,755, discloses a method for neutralizing the adverse effects of cigarette smoke on the cilia of the respiratory tract by spraying a solution of 10% citric acid on the tobacco. The action of the citric acid is not explained, and the disclosure specifies that the citric acid does not appear to remove or react with any of the noxious components of the tobacco.

U.S. Pat. No. 4,195,645, discloses a tobacco-substitute smoking material containing tobacco alkaloid material and a method for retaining the nicotine in the tobacco-substitute. A plurality of combustible microcapsules containing a tobacco alkaloid material along with an acid having a pk value of 5 or less, such as citric acid, or d-tartaric acid and the like are incorporated into the tobacco substitute.

U.S. Pat. No. 4,896,683, discloses a method for controlling the amount of nicotine which passes through a cigarette filter using at least one water soluble metal salt of a weak acid, and the water soluble salt of a strong acid. The salt of the weak acid, used to maintain an alkaline pH, increases the amount of nicotine that passes through the filter. It is the salt of the strong acid, such as hydrochloric or hydrobromic acid, added to the filter which decreases the amount of nicotine that passes through the filter.

U.S. Pat. No. 4,729,390, discloses a cigarette filter composed of diacetyl tartaric acid esters of monoglycerides for removing the tar and nicotine from cigarette smoke. The filter, preferably made of cellulose acetate, with the added diacetyl tartaric acid ester only removes between about 41% to about 50% of the nicotine from the smoke.

U.S. Pat. No. 3,079,929, discloses a method for making cigarette filters hydrophilic to improve the absorptive ability of liquid tar and nicotine from cigarette smoke. The filter is composed of cotton, cellulose fibers and viscose, i.e., a regenerated cellulose material. The disclosure does not specify or suggest the amount of tar and nicotine that the filter removes from tobacco smoke.

U.S. Pat. No. 2,806,474, discloses a method for making an improved "active" cellulose acetate. Cellulose acetate is said to be "active" because the surface is highly receptive to picking up and condensing vapors or particulate smoke passing over it. The improvement of the invention lies in applying a water-soluble adhesive, such as starch or methyl cellulose, to cellulose acetate flakes. The cellulose acetate flakes are then extruded to form rods, the individual flakes being held together by the adhesive. The rods are then cut into cylinders of desired length. The disclosure does not specify or suggest the effectiveness of the filter for removing tar and nicotine from tobacco smoke.

U.S. Pat. No. 2,228,383, discloses a hydrophobic cigarette filter composed of cellulose esters with almost completely esterified hydroxyl groups, such as cellulose triacetate. The hydrophilic cellulose acetate absorbs less moisture than non-esterified cellulose acetate, but the esterified cellulose acetate manages to absorb large quantities of tar and nicotine. However, the amount of tar and nicotine absorbed by the cellulose ester filter is less than the total amount of tar and nicotine that passes into the filter.

Therefore, there is still a need for a tobacco smoke filter that absorbs a vast majority of the tar and nicotine as well as other noxious substances from tobacco smoke.

SUMMARY OF THE INVENTION

It has now been discovered that a tobacco smoke filter composed of equal quantities of two organic acids or salts of organic acids or an organic acid and the salt of an organic acid in combination with a fibrous filament material can retain large quantities of the noxious substances found in tobacco smoke. In particular, this novel composition retains the majority of tar and nicotine from tobacco smoke. The organic acids or salts of organic acids are dissolved in an aqueous medium to form a uniform solution. The aqueous solution can then be sprayed onto the fibrous material or the fibrous material can be dipped into the aqueous solution. When tobacco smoke passes into the filter, large quantities of tar, nicotine and other noxious substances are absorbed by the filter and fail to reach the smoker, thus significantly reducing the hazards of smoking tobacco.

DETAILED DESCRIPTION OF THE INVENTION

Figure 1A:
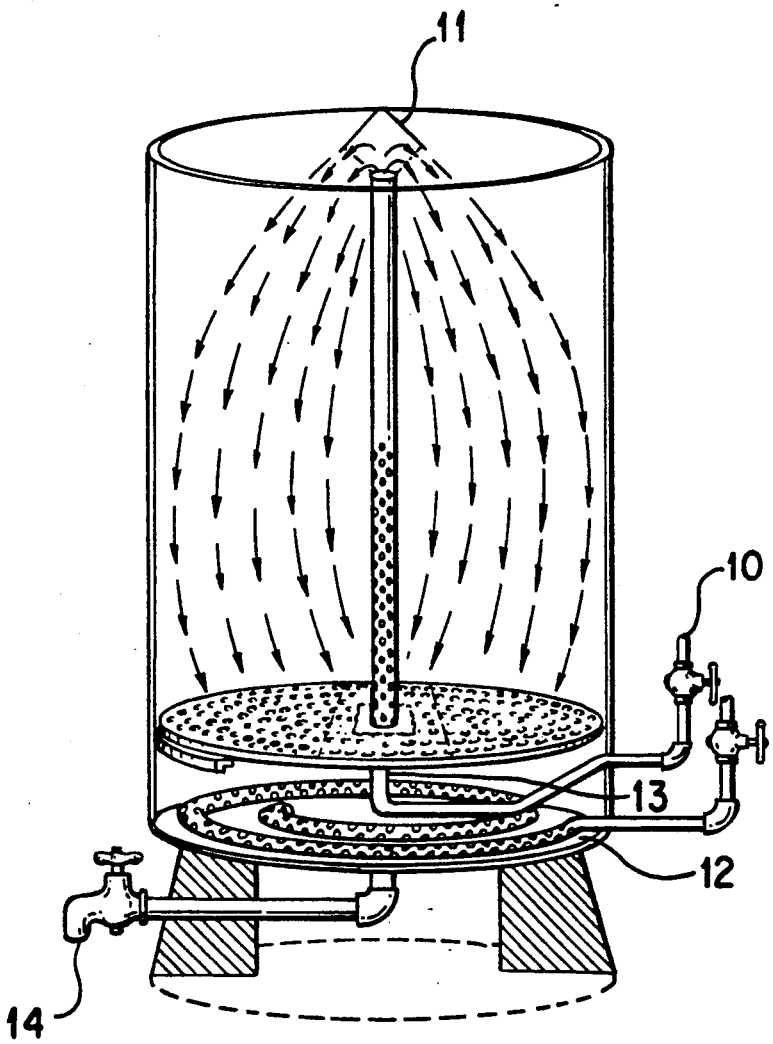
FIG. 1 shows an open boiler and the fibrous material used to make the filter being washed of plasticizer in the open boiler.

In accordance with the present invention, an aqueous solution comprising equal quantities of two organic acids applied in sufficient quantity to a filter element retains the majority of tar and nicotine as well as various quantities of other noxious substances, such as carbon monoxide, nitrous oxides, hydrogen cyanide, sulfur dioxide and the like, from tobacco smoke. Equal quantities, by weight, of two organic acids are dissolved in distilled water or deionized water and the like. The aqueous composition is stirred until a uniform solution of the organic acids is formed. If the acids are in solid form, the aqueous composition is stirred until all the solid particles are in solution. Since the solubility of the organic acids employed to practice this invention varies, the amount of time required to stir the composition to form a uniform solution can vary. The temperature at which the organic acids are mixed at is not critical, and if one or both acids employed does not go into solution easily, the aqueous composition can be heated to speed up the dissolution process. The concentration of each acid in solution ranges from about 5% w/v to about 100% w/v. The preferred range varies depending upon the two acids employed.

The organic acids employed to practice this invention have at least one pk value of about 5 or less. Such organic acids are citric acid, tartaric acid, fumaric acid, D(−) gluconic acid-δ-lactone, sorbic acid, erythorbic acid, 2-ethyl pyromecenic acid, 3-hydroxy-2-γ-pyrone, propionic acid and ascorbic acid and the like. The salts of organic acids also can be employed to practice this invention. Equal quantities of two salts of an organic acid, or the combination of an organic acid and the salt or an organic acid in equal quantities also can be employed. Preferably, the sodium, potassium or calcium salts of an organic acid are used, such as sodium citrate, sodium gluconate, potassium citrate, potassium gluconate and calcium citrate and the like. In addition to the organic acids and the salts of organic acids, some polyhydric alcohols, such as sorbitol, and maltol and the like, can be mixed together in equal quantities or mixed with an organic acid or salt of an organic acid in an aqueous medium and applied to the filter material.

Any combination of any two of the foregoing organic acids, salts of organic acids or polyhydric alcohols can be applied to a filter element to practice this invention. However, the preferred combinations are citric acid with fumaric acid, citric acid with potassium sorbitrate or tartaric acid with potassium sorbitrate wherein the amount of each acid or salt of an acid in the aqueous solution ranges from about 1 part solute:20 parts solvent to about 1 part solute:5 parts solvent, but the preferred range is from about 1 part solute:10 parts solvent to about 1 part solute:5 parts solvent. The most preferred combination is citric acid with tartaric acid wherein the concentration of each acid ranges from about 1 part solute:20 parts solvent to about 1 part solute:10 parts solvent. The material to be treated with the aqueous solution can be sprayed with the solution or dipped into the solution or coated with the solution by any suitable means.

The filter element used to practice this invention is characteristically composed of a fibrous filament material made from cellulose acetate, regenerated cellulose, i.e., viscose and the like, paper, cotton, nylon, rayon, gauze, polyolefins, such as polypropylene, polyvinylidine chloride, polyethylene and polystyrene, and the like or combinations of the foregoing materials. In fact, any material used to make the filter element of tobacco smoke filters can be used to practice this invention. However, the preferred material is cellulose acetate tow. If the fibrous material is coated with a plasticizer, preferably the fibrous material is deplasticized or degreased, i.e., removing any oils, fats, waxes or other coatings from the fibrous material. Deplasticizing or degreasing makes the fibrous material hydrophilic such that it absorbs more moisture from the tobacco smoke than if it were coated.

In practicing the preferred embodiment of this invention, the fibrous material is deplasticized with an aqueous preparation consisting of 25 parts of caustic soda (sodium hydroxide) or alternatively 29 parts of potassium hydroxide, 10 parts of a mixture of anhydrous sodium carbonate, or anhydrous sodium borate or soda lime, with an equal quantity of soluble soda (salts of acids such as sodium bicarbonate, sodium acetate, potassium acetate, potassium phosphates or sodium phosphates), 2 parts sodium bisulfite solution of 38° baume, or sodium benzoate or sodium metabisulfite and the like, 2 parts of softener and 2500 parts of water. The softener consists of 12 parts of melted white tallow or any solid fat, 12 parts of caustic soda in flake form, 0.4 parts of a mixture having equal quantities of soluble soda and anhydrous sodium carbonate in 30 parts of water. The foregoing components are mixed together and heated until they have all dissolved forming a uniform solution. The components do not have to be combined in any particular order.

After the deplasticizing solution has been prepared, it is placed in a pressure cooker or boiler or any device adequate for boiling or heating liquids. The fibrous material to be deplasticized is placed in the boiler containing the deplasticizing solution. The fibrous material should be completely covered with the deplasticizing solution. The fibrous material is boiled for about 10 to about 15 hours. The whiter the fibrous material, the shorter the boiling time required to remove the plasticizer. The deplasticizing solution can be heated by any suitable means such as by steam.

Figure 1B:
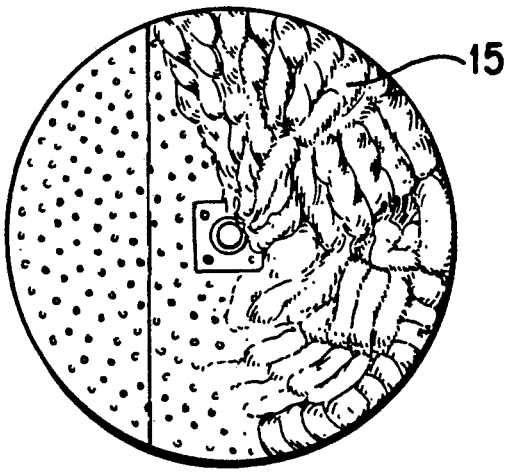

FIG. 1*a* shows an open boiler which can be used to boil the deplasticizing solution. The deplasticizer solution is fed through the supplying tube 10 and up through the iron lid cap 11. The arrows indicate the path of the deplasticizer as it enters the open boiler. Steam enters through tube 12 and passes up through the pores in coil 13. FIG. 1*b* shows a top view of the open boiler containing the material to be deplasticized 15. Once the process has been completed, the deplasticizer solution can be drained from faucet 14 as shown in FIG. 1*a*.

After the fibrous material is boiled, the desplasticizer solution is drained from the boiler and the material is washed with boiling water for about 30 to 60 minutes. The hot water is then drained from the boiler, and the fibrous material is washed with cold water for about 30 to about 60 minutes. The fibrous material is then formed into compact structures according to the methods as practiced in the art, such as bundles, of desired length and diameter to be used as filter elements in tobacco smoke filters for cigarettes, pipes or any device used to smoke tobacco or absorb the noxious substances from tobacco smoke. The tobacco smoke filter of the preferred embodiment of the present invention has a length of about 21 mm to about 33 mm, a diameter of about 7.0 mm to about 8.0 mm, a circumference of about 24 mm to about 25 mm, and a pressure drop of about 16.0 to about 18.0 mm/sec. Each filter element has from about 10,000 to about 20,000 filaments.

After the filter elements are formed into their desired size and shape, each is placed in any suitable centrifuge and centrifuged for about 15 minutes to about 20 minutes at about 2,000 to about 4,000 rpm to remove any water retained by the fibrous filaments. If large quantities of material to be used for the filter element are deplasticized, the material can be placed in an industrial centrifuge and centrifuged at about 1000 TPM to about 2000 TPM for about 15 to 20 minutes. The filters are then further dried by air drying them for 24 hours to allow any water particles left in the material to evaporate.

Figure 2:
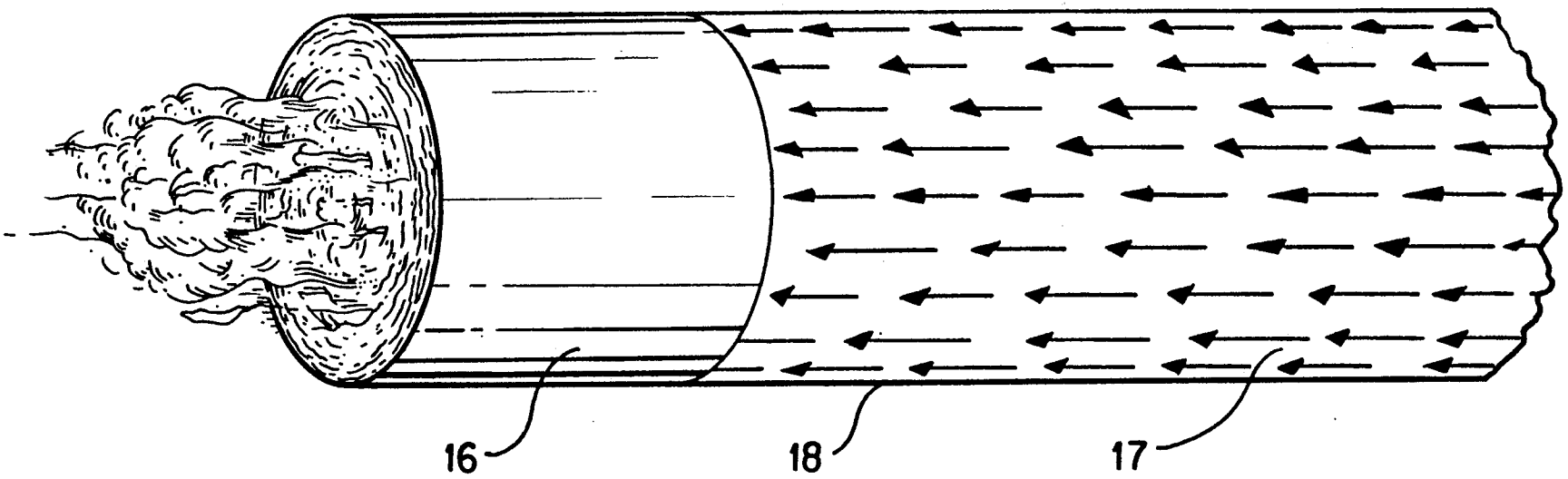
FIG. 2 is a diagrammatic sectional view of a cigarette made in accordance with this invention.

Once the filters have dried, they are treated with a solution of the organic acids, salts of organic acids or polyhydric alcohols. The solution can be sprayed onto the filter or the filter can be dipped into the solution or the solution can be applied to the filter by any suitable means. A sufficient amount of the solution is applied such that the entire filter is saturated with the solution. If the filter element is to be used in a cigarette, the filter element is joined to a tobacco portion by wrapping the filter and tobacco in a sufficient amount of plug wrap paper in accordance with the art to form a cigarette. The thickness of the plug wrap paper ranges from about 0.036 microns to about 0.06 microns. FIG. 2 shows how the filter 16 and tobacco portion 17 are wrapped by the plug wrap paper 18 to form a cigarette. The tobacco portion of the cigarette typically ranges in length of from about 40 mm to about 60 mm, but there is no limit on the size of the cigarette employed to practice this invention.

When the cigarette is lit and the smoker inhales, a suctional force is created. The combination of the high temperature and suctional force causes the tar, nicotine, and facts (impurities such as dust particles from the air) to melt to a liquid having the consistency of ink. The suctional force draws the liquified tar, nicotine, facts and noxious gases through the tobacco portion of the cigarette toward the filter as is shown by the arrows in FIG. 2. As the liquified tar, nicotine and other noxious materials come into contact with the filter, the organic acids, or salts of organic acids or the polyhydric alcohols along with the fibrous filaments of the filter element absorb a majority of the tar and nicotine that passes into the filter. The filter can absorb from about 94.5% to about 95.4% of the nicotine and about 90.5% to about 92.4% of the tar. If the fibrous filter element is extended in length for about another 5 mm to about 7 mm, the filter can retain from about 97% to about 100% of the nicotine and from about 94% to about 98.7% of the tar that enters the filter element. The smoke that is inhaled by the smoker is predominantly free of tar and nicotine as well as many of the other noxious substances found in tobacco smoke, thus producing a cleaner cigarette smoke.

Figure 3:
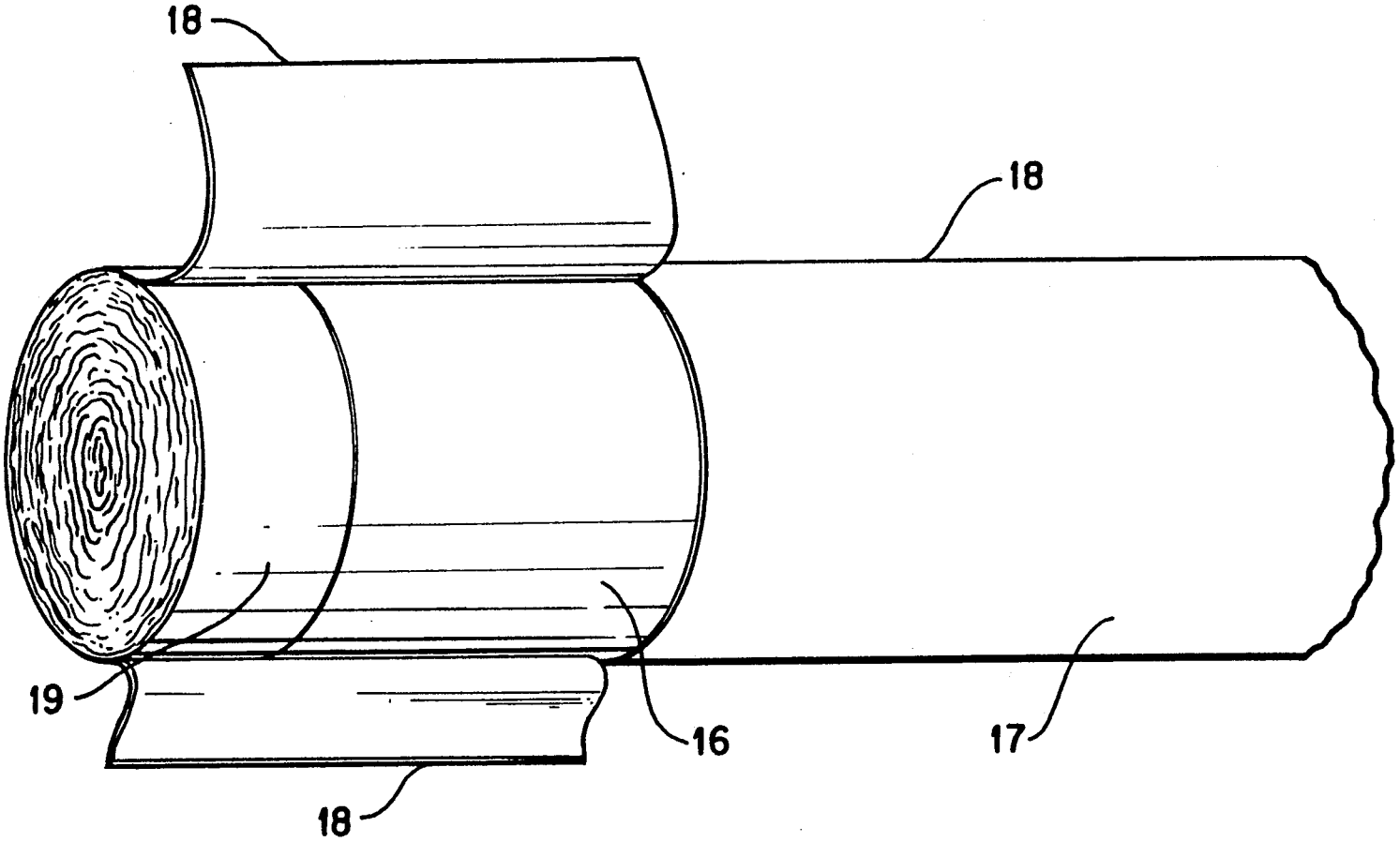
FIG. 3 is a diagrammatic sectional view of a cigarette similar to the cigarette in FIG. 1 but having an additional filter element.

The life of the filter, in particular a filter made from cellulose acetate, ranges from about six months to about seven months before the filter becomes too acidic causing an objectionable flavor. However, the life of the filter element can be increased by about another 2 to 6 months by adding an additional filter element which has not been treated with organic acids or salts of organic acids to the treated filter element. FIG. 3 shows a cigarette with the additional filter element 19 attached to the treated filter element 16 with a portion of the plug wrap paper 18 laid open to show how the two filter elements are joined. The additional filter element ranges from about 5 mm to about 7 mm in length.

This invention is illustrated by the following examples. However, the examples are not intended to limit the scope of this invention but to further illustrate and provide a better understanding of the invention.

EXAMPLE I

Analysis of the Retention of Tar and Nicotine of Treated and Untreated Cigarette Filters.

One-hundred grams of fine granular anhydrous citric acid U.S.P. and one-hundred grams of fine granular tartaric acid N.F. were weighed out on an analytical balance (acids were manufactured by Pfizer Inc.). Both acids were dissolved in a beaker containing 1,000 ml of distilled water at room temperature (20° C.±2° C). The composition was stirred until all the granules were dissolved resulting in a uniform solution.

The filters from fifty out of one-hundred Marlboro King® filter soft pack cigarettes were separated from the tobacco portion of the cigarettes. These cigarettes were dipped into the foregoing solution long enough for each filter to become saturated with the acid solution. The filters were then air-dried for 24 hours and then reattached to the tobacco portions of the cigarettes by winding a sufficient amount of plug wrap paper around the filter and tobacco to secure both halves together.

Fifty of the one-hundred cigarettes with the treated filters were tested for tar and nicotine retention at Case Consulting Laboratories, Inc. (Whippany, N.J.). The control consisted of the remaining fifty Marlboro King® filter soft pack cigarettes without treated filters. The cigarettes were smoked in a 20-port Phipps and Bird automatic smoking machine. Ten of the ports were assigned to the cigarettes having the untreated filters and ten to the cigarettes having the treated filters.

In accordance with the standard FTC procedure, the machine was programmed to one 35 ml puff of two seconds duration once a minute. Five cigarettes were smoked through each port and the total particulate matter collected on a preweighed Cambridge filter which was reweighed to determine the total particulate matter collected on the filter. Smoking conditions were maintained at 75° F.±2° F. and 60%±2% relative humidity. The collected particulate matter was analyzed for tar and nicotine according to the conventional methods as practiced in the art. This resulted in ten values for five cigarettes smoked through each port. The results of this test are disclosed in Tables I and II.

On the average, only 0.05 mg of nicotine/cigarette and 1.3 mg of tar/cigarette passed through the treated cigarette filter and collected on the Cambridge filter. However, with respect to the untreated filter, 1.18 mg of nicotine/cigarette and 17.1 mg of tar/cigarette passed through the cigarette filter and collected on the Cambridge filter. These results clearly disclose that the treated cigarette filters retained a significantly greater amount of tar and nicotine than did the untreated filters.

TABLE I

CIGARETTE SMOKE RESULTS
MARLBORO KING ® (citric acid/tartaric acid)
(Treated Filter)

| Port Number | Puffs/ Cigarette | Total Particulate Matter mg/Cigarette | Nicotine mg/Cigarette | Tar mg/Cigarette |
|---|---|---|---|---|
| 1 | 9.7 | 1.3 | 0.05 | 1.1 |
| 2 | 9.3 | 1.8 | 0.06 | 1.6 |
| 3 | 9.6 | 1.7 | 0.06 | 1.5 |
| 4 | 9.4 | 1.6 | 0.06 | 1.4 |
| 5 | 9.7 | 1.4 | 0.05 | 1.3 |
| 6 | 9.8 | 1.5 | 0.04 | 1.5 |
| 7 | 9.5 | 0.7 | 0.03 | 0.6 |
| 8 | 9.1 | 1.2 | 0.05 | 1.0 |
| 9 | 9.5 | 1.3 | 0.05 | 1.1 |
| 10 | 9.3 | 2.0 | 0.05 | 1.8 |
| Average: | | | 0.05 | 1.3 |
| Standard Deviation: | | | 0.0094 | 0.348 |
| Variance: | | | 0.00008 | 0.121 |

TABLE II

CIGARETTE SMOKE RESULTS
MARLBORO KING ® (Untreated Filter)

| Port Number | Puffs/ Cigarette | Total Particulate Matter mg/Cigarette | Nicotine mg/Cigarette | Tar mg/Cigarette |
|---|---|---|---|---|
| 11 | 7.7 | 20.9 | 1.19 | 16.8 |
| 12 | 7.8 | 21.6 | 1.20 | 17.1 |
| 13 | 8.3 | 20.9 | 1.10 | 16.2 |
| 14 | 8.0 | 21.4 | 1.14 | 16.9 |
| 15* | 7.8 | 16.1 | 0.81 | 14.3 |
| 16 | 8.1 | 22.4 | 1.19 | 17.5 |
| 17 | 7.9 | 22.8 | 1.19 | 17.5 |
| 18 | 8.0 | 23.8 | 1.28 | 18.0 |
| 19 | 8.0 | 22.0 | 1.16 | 17.6 |
| 20 | 7.9 | 20.7 | 1.17 | 16.6 |
| Average: | | | 1.18 | 17.1 |
| Standard Deviation: | | | 0.049 | 0.566 |
| Variance: | | | 0.0024 | 0.320 |

The summary values are:

| | Average Nicotine | Average Tar |
|---|---|---|
| Marlboro King ® (citric acid/ tartaric acid Filters) | 0.05 mg/cigarette | 1.3 mg/cigarette |
| Marlboro King ® | 1.18 mg/cigarette | 17.1 mg/cigarette |

*Rejected values.
Source: Case Consulting Laboratories, Inc. (Whippany, N.J.)

EXAMPLE 2

Table III discloses various combinations of organic acids and salts of organic acids that were applied to plasticizer free cigarette filters composed of cellulose acetate tow to test their ability to retain tar and nicotine from tobacco smoke (acids and salts were manufactured by Pfizer Inc.) Each combination was tested for its ability to retain tar and nicotine at four different concentrations. Equal quantities of each organic acid or salt of an organic acid were dissolved and mixed in 1000 ml of distilled water at room temperature (20° C.±2° C.) to form a uniform solution. Two-hundred plasticizer free cellulose acetate filters were treated with each combination of organic acid or salt of an organic acid listed in Table III (fifty filters for each concentration) and tested for tar and nicotine retention. The length of each filter was about 33 mm long and had a diameter of about 8 mm.

The cellulose acetate tow employed to make the filters was placed in an open boiler containing 2,500 ml of a deplasticizing solution (see Table IV for composition of cleaning solution) to degrease the cellulose acetate tow. The solution was brought to a boil, and the cellulose acetate was boiled for approximately one hour. The cellulose acetate was removed from the open boiler and placed in a boiling water bath for one hour. The cellulose acetate was then removed from the boiling water and placed in a cold water bath maintained at 10° C. for one hour. The cellulose acetate was then removed from the cold water bath, and was centrifuged in an industrial filtration centrifuge at approximately 1500 TPM to remove any water that the cellulose acetate retained from the deplasticizing process. The cellulose acetate was then allowed to dry further at room temperature for 24 hours to allow any remaining water droplets within the fibrous filaments of the filters to evaporate. The cellulose acetate was then formed into individual filters and treated with the various organic acid and salt solutions disclosed in Table III. The solutions were prepared and the cellulose acetate was treated according to the methods described in Example I.

Each filter was then attached to a tobacco portion. The filter and tobacco portion were joined by wrapping the two components in plug wrap paper having a thickness of about 0.035 microns. The cigarettes for each composition and concentration were smoked in an automatic smoking machine. The machine was programmed to one 35 ml puff of two seconds duration once a minute in accordance with the standard FTC procedure. Particulate matter was collected on Cambridge filters. Both the Cambridge filter and the treated filters were analyzed for the amount of tar and nicotine that each collected according to the methods as practiced in the art. The average percentage of tar and nicotine retained by the treated filters for each concentration of the several combinations of organic acids and salts of organic acids was determined. These average values are disclosed in Table III.

The average percentage retention values disclosed in Table III clearly illustrate the effectiveness of the various combinations of organic acids and salts of organic acids in retaining tar and nicotine in a cellulose acetate filter.

TABLE III

Retention of Tar and Nicotine in Cellulose Acetate Filter

| Ingredients of Solution Applied to Cellulose Acetate Filter | Amount of Each Ingredient Added to a Liter of Water | Percent of tar retained | Percent of nicotine retained |
|---|---|---|---|
| 1. Fumaric acid and D(−) gluconic acid-δ-lactone | 100 gm | 10.1 | 10.1 |
| | 200 gm | 20.2 | 20.2 |
| | 500 gm | 50.5 | 50.5 |
| | 1000 gm | 101.0 | 101.0 |
| 2 Sodium citrate and sodium gluconate | 100 gm | 10.1 | 10.1 |
| | 200 gm | 20.2 | 20.2 |
| | 500 gm | 50.5 | 50.5 |
| | 1000 gm | 101.0 | 101.0 |
| 3. Potassium gluconate and sorbistate K | 100 gm | 10.1 | 10.1 |
| | 200 gm | 20.2 | 20.2 |
| | 500 gm | 50.5 | 50.5 |
| | 1000 gm | 101.0 | 101.0 |
| 4. Potassium sorbate and sorbistat K | 100 gm | 10.1 | 10.1 |
| | 200 gm | 20.2 | 20.2 |
| | 500 gm | 50.5 | 50.5 |
| | 1000 gm | 101.0 | 101.0 |
| 5. Sodium citrate and sodium gluconate | 100 gm | 10.1 | 10.1 |
| | 200 gm | 20.2 | 20.2 |
| | 500 gm | 50.5 | 50.5 |
| | 1000 gm | 101.0 | 101.0 |

TABLE III-continued

| Retention of Tar and Nicotine in Cellulose Acetate Filter | | | |
|---|---|---|---|
| Ingredients of Solution Applied to Cellulose Acetate Filter | Amount of Each Ingredient Added to a Liter of Water | Percent of tar retained | Percent of nicotine retained |
| 6. Potassium citrate and potassium gluconate | 100 gm | 10.1 | 10.1 |
| | 200 gm | 20.2 | 20.2 |
| | 500 gm | 50.5 | 50.5 |
| | 1000 gm | 101.0 | 101.0 |
| 7. Calcium citrate and sodium chloride | 100 gm | 10.1 | 10.1 |
| | 200 gm | 20.2 | 20.2 |
| | 500 gm | 50.5 | 50.5 |
| | 1000 gm | 101.0 | 101.0 |
| 8. Calcium citrate and sorbic acid | 100 gm | 10.1 | 10.1 |
| | 200 gm | 20.2 | 20.2 |
| | 500 gm | 50.5 | 50.5 |
| | 1000 gm | 101.0 | 101.0 |
| 9. Calcium gluconate and potassium sorbate | 100 gm | 10.1 | 10.1 |
| | 200 gm | 20.2 | 20.2 |
| | 500 gm | 50.5 | 50.5 |
| | 1000 gm | 101.0 | 101.0 |
| 10. Copper gluconate and ascorbic acid | 100 gm | 10.1 | 10.1 |
| | 200 gm | 20.2 | 20.2 |
| | 500 gm | 50.5 | 50.5 |
| | 1000 gm | 101.0 | 101.0 |
| 11. Erythorbic acid and sodium propionate | 100 gm | 10.1 | 10.1 |
| | 200 gm | 20.2 | 20.2 |
| | 500 gm | 50.5 | 50.5 |
| | 1000 gm | 101.0 | 101.0 |
| 12. Sodium erythorbate and potassium gluconate | 100 gm | 10.1 | 10.1 |
| | 200 gm | 20.2 | 20.2 |
| | 500 gm | 50.5 | 50.5 |
| | 1000 gm | 101.0 | 101.0 |

TABLE IV

| Ingredients | Quantity |
|---|---|
| Formula for Washing Cellular Acetate | |
| 1. Water | 2500 ml |
| 2. Caustic soda (powdered) | 25 gm |
| 3. Anhydrous sodium carbonate and soluble soda | 10 gm |
| 4. Softener | 2 gm |
| 5. Sodium bisulfite solution of 38° baume | 2 gm |
| Softener Formula | |
| 1. Melted White Tallow | 12 gm |
| 2. Caustic soda in flake form | 12 gm |
| 3. Soluble soda and powdered anhydrous sodium carbonate | 0.4 gm |
| 4. Water | 3.0 liters |

EXAMPLE 3

Table V discloses three combinations of organic acids or an organic acid with a salt of an organic acid which were applied to plasticizer free cigarette filters composed of cellulose acetate tow to test their ability to retain tar and nicotine from tobacco smoke (chemicals were manufactured by Pfizer Inc.)

The preparation of the solutions and the cellulose acetate filters were prepared according to the procedure disclosed in Example 2. The method for analyzing the percentage of tar and nicotine retained on the treated filters also was performed according to the procedure in Example 2.

The results clearly disclose a significant amount of tar and nicotine retained on the cellulose acetate filter when the filter was treated with a 100 grams/liter solution.

TABLE V

| Retention of Tar and Nicotine in Cellulose Acetate Filter | | | |
|---|---|---|---|
| Ingredients of Solution Applied to Cellulose Acetate Filter | Amount of Each Ingredient Added to a Liter of Water | Percent of Tar Retained | Percent of Nicotine Retained |
| 1. Fumaric acid and Citric Acid | 20 gm | 13.82 | 13.82 |
| | 50 gm | 34.55 | 34.55 |
| | 100 gm | 69.1 | 69.1 |
| 2. Citric Acid and Sorbistat K ® | 20 gm | 13.82 | 13.82 |
| | 50 gm | 34.55 | 34.55 |
| | 100 gm | 69.1 | 69.1 |
| 3. Tartaric acid and Sorbistat K ® | 20 gm | 13.82 | 13.82 |
| | 50 gm | 34.55 | 34.55 |
| | 100 gm | 69.1 | 69.1 |

EXAMPLE 4

Table VI discloses aqueous solutions composed of two polyhydric alcohols and two combinations of a polyhydric alcohol and a salt of an organic acid which were applied to plasticizer free cigarette filters composed of cellulose acetate tow to test their ability to retain tar and nicotine from tobacco smoke (chemicals were manufactured by Pfizer Inc.).

The preparation of the solutions and the cellulose acetate filters were performed according to the procedures disclosed in Example 2. The procedure for analyzing the percentages of tar and nicotine retained on the treated filters also was performed according to the procedures in Example 2.

The results clearly disclose that all of the tar and nicotine was retained on the cellulose acetate filter with a 1000 grams/liter solution.

TABLE VI

| Ingredients of Solution Applied to Cellulose Acetate Filter | Amount of Each Ingredient Added to a Liter of Water | Percent of Tar Retained | Percent of Nicotine Retained |
|---|---|---|---|
| 1. Sorbitol crystalline and sodium erythorbate | 100 gm | 10.1 | 10.1 |
| | 200 gm | 20.2 | 20.2 |
| | 500 gm | 50.2 | 50.2 |
| | 1000 gm | 101.0 | 101.0 |
| 2. Maltol and Sorbitol crystalline | 100 gm | 10.1 | 10.1 |
| | 200 gm | 20.2 | 20.2 |
| | 500 gm | 50.2 | 50.2 |
| | 1000 gm | 101.0 | 101.0 |
| 3. Maltol and monosodium glutamate | 100 gm | 10.1 | 10.1 |
| | 200 gm | 20.2 | 20.2 |
| | 500 gm | 50.2 | 50.2 |
| | 1000 gm | 101.0 | 101.0 |

I claim:

1. A tobacco smoke filter which retains tar, nicotine and noxious gases of tobacco smoke, wherein the filter comprises fibrous filaments joined together in a bundle having equal quantities of two organic acids or two salts of organic acids or an organic acid and a salt of an organic acid dispersed throughout the fibrous filaments.

2. The tobacco smoke filter of claim 1, wherein the organic acid is present in aqueous solution at a concentration of from about 5% to about 20% weight to volume.

3. The tobacco smoke filter of claim 1, wherein the salt of an organic acid is present in aqueous solution at a concentration of from about 5% to about 20% weight to volume.

4. The tobacco smoke filter of claim 1, wherein the organic acid comprises citric acid, tartaric acid, fumaric acid, sorbic acid, propionic acid, ascorbic acid, erythorbic acid, D(−) gluconic-acid δ-lactone, 2-ethyl pyromeconic acid, or 3-hydroxy-2-methyl-γ-pyrone.

5. The tobacco smoke filter of claim 1, wherein the salt of an organic acid comprises sodium citrate, sodium propionate, sodium gluconate, potassium gluconate, potassium sorbate, sodium benzoate, potassium citrate, calcium citrate, monosodium glutamate, copper gluconate, or sodium erythorbate.

6. The tobacco smoke filter of claim 1, wherein the fibrous filaments comprise cellulose acetate, regenerated cellulose, paper, cotton, nylon, rayon, polypropylene, polyvinylidene chloride, polyethylene, or polystyrene or combinations thereof.

7. The tobacco smoke filter of claim 1, wherein the fibrous filaments are plasticizer free.

8. The tobacco smoke filter of claim 1, wherein the filter comprises an additional untreated fibrous component ranging in length from about 2 mm to about 7 mm.

9. A tobacco smoke filter which retains tar, nicotine and noxious gases of tobacco smoke, wherein the filter comprises fibrous filaments of hydrophilic cellulose acetate joined together in a bundle wherein equal quantities of citric acid and tartaric acid in aqueous form, each in a concentration of from about 5% to about 10% weight to volume, are dispersed throughout the cellulose acetate fibers.

10. The tobacco smoke filter of claim 9, wherein an additional filter element, composed of untreated hydrophilic cellulose acetate and having a length ranging from about 2 mm to about 7 mm, is added to the filter.

11. A tobacco smoke filter which retains tar, nicotine and noxious gases of tobacco smoke wherein the filter comprises fibrous filaments joined together in a bundle having equal quantities of two polyhydric alcohols or a polyhydric alcohol and the salt of an organic acid dispersed throughout the bundle of fibrous filaments.

12. The tobacco smoke filter of claim 11, wherein the polyhydric alcohol comprises sorbitol, or maltol.

13. The tobacco smoke filter of claim 11, wherein the salt of an organic acid comprises monosodium glutamate, sodium erythorbate, sodium citrate, sodium propionate, sodium gluconate, potassium gluconate, potassium sorbate, sodium benzoate, potassium citrate, calcium citrate or copper gluconate.

14. The tobacco smoke filter of claim 11, wherein the fibrous filaments comprise one or more of cellulose acetate, regenerated cellulose, paper, cotton, nylon, rayon, polypropylene, polyvinylidene chloride, polyethylene or combinations thereof.

15. The tobacco smoke filter of claim 11, wherein the fibrous filaments are hydrophilic.

16. A method for retaining tar, nicotine and noxious gases in a tobacco smoke filter comprising:

a) mixing together in an aqueous medium two organic acids or two salts of an organic acid or an organic acid and a salt of an organic acid in equal quantities to form an aqueous solution; and b) applying the aqueous solution to a filter element in sufficient quantity, wherein the organic acid or salt of an organic acid retains tar, nicotine and noxious gases from tobacco smoke.

17. The method according to claim 16, wherein the filter element is deplasticized to make the filter element hydrophilic.

18. The method according to claim 16, wherein the organic acid comprises citric acid, tartaric acid, fumaric acid, sorbic acid, propionic acid, ascorbic acid, erythorbic acid, D(−) gluconic acid-δ-lactone, 2-ethyl pyromeconic acid, or 3-hydroxy-2-methyl-γ-pyrone.

19. The method according to claim 16, wherein the salt of an organic acid comprises sodium citrate, sodium propionate, sodium gluconate, potassium gluconate, potassium sorbate, sodium benzoate, potassium citrate, calcium citrate, monosodium glutamate, copper gluconate, or sodium erythorbate.

20. The method according to claim 16, wherein the filter element comprises one or more of cellulose acetate, regenerated cellulose, paper, cotton, nylon, rayon, polypropylene, polyvinylidene chloride, polyethylene or polystyrene or combinations thereof.

21. The method according to claim 16, wherein each organic acid or each salt of an organic acid comprises from about 5% to about 100% weight to volume of the aqueous solution.

22. The method according to claim 16, wherein the filter element comprises an additional untreated filter element ranging in length from about 2 mm to about 7 mm.

23. A method for retaining tar, nicotine and noxious gases in a tobacco smoke filter comprising:

a) mixing together in an aqueous medium equal quantities of citric acid and tartaric acid to form an aqueous solution wherein each acid comprises from about 5% to 10% weight to volume of the solution; and b) applying the solution in sufficient quantity to a filter element, comprising filaments of hydrophilic cellulose acetate, such that the citric acid and tartaric acid retain tar, nicotine and noxious gases from tobacco smoke.

24. The method according to claim 23, wherein an additional filter element, composed of untreated hydrophilic cellulose acetate having a length of from about 2 mm to about 7 mm is added to the filter to extend the life of the filter.

25. A method for retaining tar, nicotine and noxious gases in a tobacco smoke filter comprising:

a) mixing together in an aqueous medium equal quantities of two polyhydric alcohols or a salt of an organic acid and a polyhydric alcohol to form a solution; and b) applying the solution in sufficient quantity to a filter element such that the polyhydric alcohol and salt of an organic acid retain tar, nicotine and noxious gases from tobacco smoke.

26. The method according to claim 25, wherein the polyhydric alcohols comprise sorbitol, or maltol.

27. The method according to claim 25, wherein the salts of an organic acid comprise sodium citrate, sodium propionate, sodium gluconate, potassium gluconate, potassium sorbate, sodium benzoate, potassium citrate, calcium citrate, monosodium glutamate, copper gluconate, or sodium erythorbate.

28. The method according to claim 28, wherein the filter element comprises one or more of cellulose acetate, regenerated cellulose, paper, cotton, nylon, rayon, polypropylene, polyvinylidene chloride, polyethylene or polystyrene.

29. The method according to claim 25, wherein each polyhydric alcohol or each salt of an organic acid comprises from about 50% to about 100% weight to volume of the solution.

* * * * *